US005797489A

United States Patent [19]

Baker

[11] Patent Number: 5,797,489

[45] Date of Patent: Aug. 25, 1998

[54] PAINTBRUSH CASE

[76] Inventor: Richard Baker, 1141 S. Alhambra Cir., Naples, Fla. 34103

[21] Appl. No.: 903,277

[22] Filed: Jul. 7, 1997

[51] Int. Cl.[6] ..... A46B 17/00; B65D 77/76

[52] U.S. Cl. ..... 206/362; 211/66; 248/110

[58] Field of Search ..... 206/362, 209, 206/1.7, 361; 211/65, 66; 248/110–113

[56] References Cited

U.S. PATENT DOCUMENTS

| | | | |
|---|---|---|---|
| 130,401 | 8/1872 | Ames . | |
| 1,471,712 | 10/1923 | Sohnle . | |
| 1,667,044 | 4/1928 | Oddo . | |
| 2,479,509 | 8/1949 | Pichniarczyk | 206/362 X |
| 2,940,200 | 6/1960 | Endlich | 211/65 X |
| 3,446,337 | 5/1969 | Blademon | 206/1.7 |
| 4,162,005 | 7/1979 | Linger | 206/362 |
| 4,573,569 | 3/1986 | Parker . | |
| 4,756,405 | 7/1988 | Crozier . | |

*Primary Examiner*—Bryon P. Gehman
*Attorney, Agent, or Firm*—Merrill N. Johnson

[57] ABSTRACT

A paintbrush case (1) has a selection of paintbrushes hanging with brush handles (9) and having sides (3, 4, 21, 22) that open downwardly to reveal brush bristles (11) and to provide convenient access while the case stands reliably where positioned. Air vents (23) in tops and bottoms of the case aid drying of the brushes after they have been cleaned and prevent buildup of expanded gases from paint. In addition to convenience and efficiency for professional and do-it-yourself painters alike, a major use of this paintbrush case is keeping track of and caring for paintbrushes at construction sites.

20 Claims, 1 Drawing Sheet

PAINTBRUSH CASE

BACKGROUND OF THE INVENTION

1. Field of the Invention

This invention relates to paintbrush containers and in particular to a paintbrush case for carrying a selection of paintbrushes in handle-down attitude.

2. Relation to Prior Art

Typically for paint contracting, a selection of different sizes and shapes of paintbrushes must be carried by professional painters in an individually makeshift manner. Using them, cleaning them and storing them variously by different painters is a continual problem. Nowadays in addition, professional painters are usually workers for contract painters that often supply the paintbrushes for the painters. Handling paintbrushes efficiently and effectively, keeping track of them, preventing them from being stolen and assuring that all painters working on particular painting contracts are supplied with adequate paintbrushes are recurring problems for painting contractors. Efficiency and quality of painting work can be decreased by as much as 25-to-35 percent just by how paintbrushes are handled. It is to provide a reliable means for handling professional paintbrushes, whether by contractors, by individual painters or by do-it-yourself painters that this paintbrush case has been invented.

Previous paintbrush containers have not addressed problems of professional painting in a manner taught by this invention. Examples of different but related paintbrush containers are described in the following patent documents. U.S. Pat. No. 4,756,405, issued to Crozier, described an artist brush box having artist brushes attached with a clothespin type of clasp to a rod in a wall of a carrying case. U.S. Pat. No. 4,573,569, issued to Parker, taught a sales-display and storage container for artist brushes in a case that hinged backwards in a triangular form. U.S. Pat. No. 1,667,044, issued to Oddo, taught a hinged clam-like container that held paintbrushes in a handle-up attitude. U.S. Pat. No. 1,471,712, issued to Sohnle, described a trunk-like carrying case in which paintbrushes were suspended in a handle-up attitude also. U.S. Pat. No. 130,401, issued to Ames in 1872, also described a brush container or rack in which brushes were positioned handle-up with brushes resting on a floor of the container.

SUMMARY OF THE INVENTION

In light of need for improvement in efficiency, effectiveness, convenience, accountability and security in handling paintbrushes, objects of this invention are to provide a paintbrush case which:

- Can be carried easily, positioned reliably and accessed conveniently for painting with different sizes and types of paintbrushes as needed at painting work sites;
- Contains brushes for storage temporarily or for long periods in a handle-down attitude for ease of access and for dripping away from brushes after being cleaned;
- Provides air vents for drying in a brush-protected position; and
- Contains select combinations and pluralities of brushes for particular use conditions and for accountability by users.

This invention accomplishes these and other objectives with a paintbrush case having a selection of paintbrushes hanging handle-down with side opening to reveal brush ends and to provide convenient access while the case stands reliably where positioned. Ventilation in tops and bottoms of the case aids drying of the brushes after they have been cleaned and avoids buildup of expanded gases from paint.

BRIEF DESCRIPTION OF DRAWINGS

This invention is described by appended claims in relation to description of a preferred embodiment with reference to the following drawings which are described briefly as follows:

DESCRIPTION OF PREFERRED EMBODIMENT

Figures 1, 2, 3, 4, 5, 6, 7, 8, 9, 10, 11, 12:
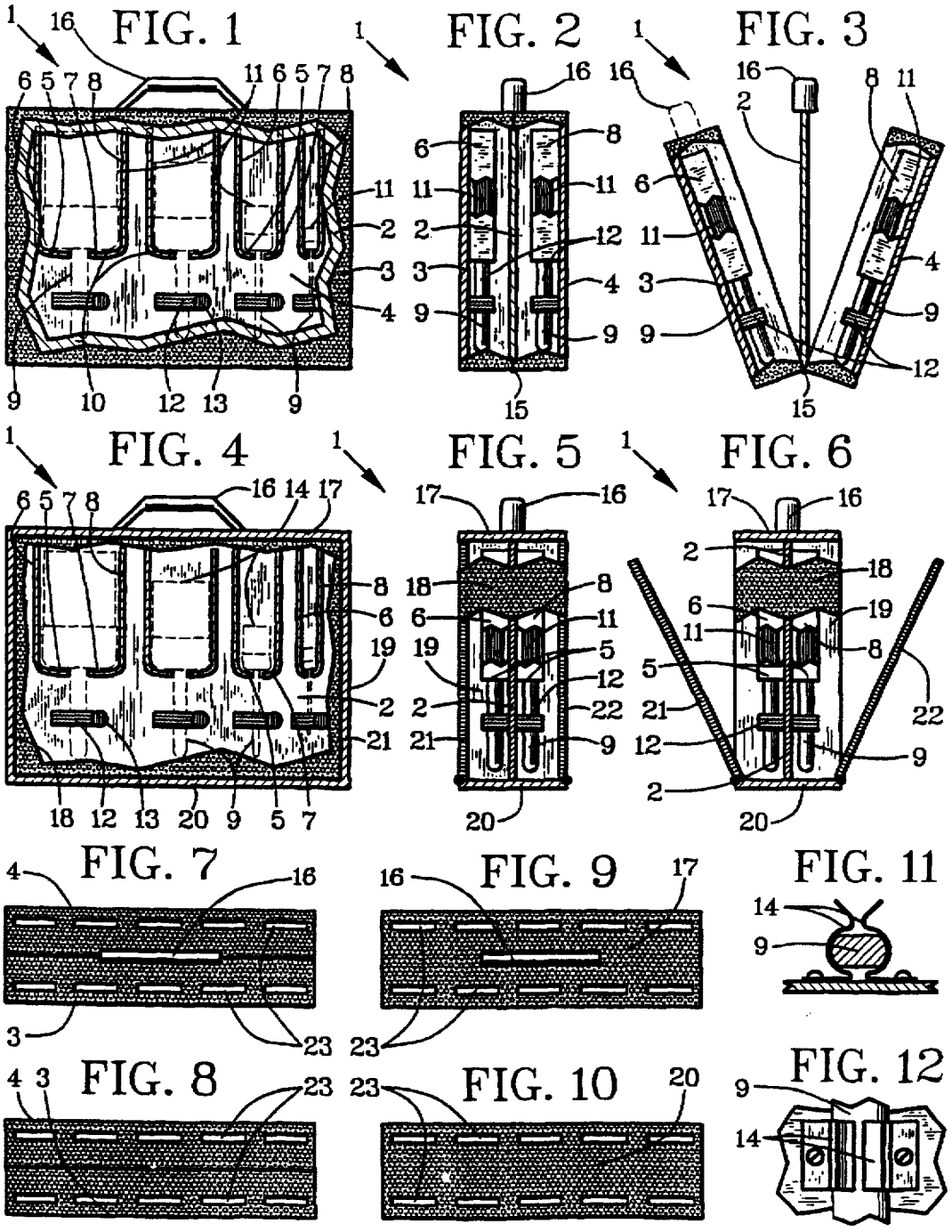
FIG. 1 is a partially cutaway elevation view of an embodiment with paintbrush holders in walls of a paintbrush case.
FIG. 2 is a partially cutaway end view of the FIG. 1 illustration in closed mode.
FIG. 3 is a partially cutaway end view of the FIG. 1 illustration in open mode.
FIG. 4 is a partially cutaway elevation view of an embodiment with paintbrush holders on opposite sides of a center walls
FIG. 5 is a partially cutaway end view of the FIG. 4 illustration in closed mode.
FIG. 6 is a partially cutaway end view of the FIG. 4 illustration in open mode.
FIG. 7 is a top view of the FIG. 1 illustration.
FIG. 8 is a bottom view of the FIG. 1 illustration.
FIG. 9 is a top view of the FIG. 4 illustration.
FIG. 10 is a bottom view of the FIG. 4 illustration.
FIG. 11 is a side elevation view of a spring-material strap for either embodiment.
FIG. 12 is a top view of the spring-material strap.

Reference is made first to FIGS. 1–3. A paintbrush case 1 has a center plate 2 with a top edge proximate a top of the paintbrush case 1, a bottom edge proximate a bottom of the paintbrush case 1, a first end proximate a first end of the paintbrush case 1 and a second end proximate a second end of the paintbrush case 1. A first-side wall 3 of the paintbrush case 1 is hinged to a first side of the bottom of the paintbrush case 1 and a second-side wall 4 of the paintbrush case 1 is hinged to a second side of the bottom of the paintbrush case 1. The first-side wall 3 and the second-side wall 4 can have additionally side walls, top walls and bottom walls extended inwardly from edges respectively.

A plurality of first-side brush holders are sized and shaped to hold a select plurality, type, size and shape of paintbrushes in handle-down attitude on an inside periphery of the first-side wall 3. In like manner, a plurality of second-side brush holders are sized and shaped to hold a select plurality, type, size and shape of paintbrushes in handle-down attitude on an inside periphery of the second-side wall 4. The plurality of first-side brush holders have first holder bases 5 from which first holder walls 6 are extended upward vertically and the plurality of second-side brush holders have second holder bases 7 from which second holder walls 8 are extended upward vertically. The first holder bases 5 and the second holder bases 7 are positioned a distance apart to allow brush handles 9 of select sizes to extend downwardly intermediate the first holder bases 5 and the second holder bases 7. The first holder bases 5 and the second holder bases 7 are employed to contain shoulders 10 of brushes with bristles 11 extended upwardly from the shoulders 10 with the brush handles 9 positioned intermediate the first holder walls 5 and the second holder walls 7.

Handle containers 12 are positioned vertically below the first holder bases 5 and the second holder bases 7. The handle containers 12 can be pliable or resilient with an optional snap 13. Optionally, spring-material straps 14 depicted in FIGS. 11–12 can be employed.

A select mix of sizes and shapes of paintbrushes is intended for this paintbrush case 1. For most contract painting and do-it-yourself painting, the mix of paintbrushes will include a four-inch brush, a three-inch brush, a two-inch brush and a one-inch brush as depicted in FIGS. 1 and 4.

Hinged connection of the first-side wall 3 and the second-side wall 4 to the paintbrush case 1 can be with at least one central hinge 15 that also can be attached to the center plate 2.

A case handle 16 can be positioned selectively on a top portion of either the first-side wall 3, the second-side wall 4 or the center plate 2.

Referring to FIGS. 4–6, the plurality of first-side brush holders can be positioned on a first side of the center plate 2 and the plurality of second-side brush holders can be positioned on a second side of the center plate 2. For this embodiment, the center plate 2 can have a top wall 17, a first-end wall 18, a second-end wall 19 and a bottom wall 20. A first-side plate 21 can be hinged to a first side of the bottom wall 20 and a second-side plate 22 can be hinged to a second side of the bottom wall 20. This allows paintbrushes to be positioned centrally on a firm base with minimal tipping effect while brushes are being accessed.

Referring to FIGS. 7–10, air vents 23 are provided preferably in tops of paintbrush cases 1 as depicted in FIGS. 7 and 9 and/or in bottoms of paintbrush cases 1 as depicted in FIGS. 8 and 10.

Referring to FIGS. 11–12, a brush handle 9 can be inserted between beveled entries on spring-material straps 14 which hold the brush handles 9 in place below holder bases 5 and 6 that are described in relation to FIGS. 1–6.

A new and useful paintbrush case having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A paintbrush case comprising:

a center plate having a top edge proximate a top of the paintbrush case, a bottom edge proximate a bottom of the paintbrush case, a first end proximate a first end of the paintbrush case, and a second end proximate a second end of the paintbrush case;

a first-side wall hinged to a first side of the bottom of the paintbrush case;

a second-side wall hinged to a second side of the bottom of the paintbrush case;

at least one air vent in at least one wall of the paintbrush case;

a plurality of first-side brush holders that are sized and shaped to hold a select plurality, type, size and shape of paintbrushes in handle-down attitude in a first side of the paintbrush case;

a plurality of second-side brush holders that are sized and shaped to hold a select plurality, type, size and shape of paintbrushes in handle-down attitude in a second side of the paintbrush case; and a case handle proximate a top of the paintbrush case.

2. A paintbrush case as described in claim 1 wherein:

the plurality of first-side brush holders are positioned on an inside periphery of the first-side wall; and the plurality of second-side brush holders are positioned on an inside periphery of the second-side wall.

3. A paintbrush case as described in claim 2 wherein:

the plurality of first-side brush holders have first holder bases from which first holder walls are extended upward vertically and second holder bases from which second holder walls are extended upward vertically; and the first holder bases and the second holder bases are positioned a distance apart to allow brush handles to extend downwardly intermediate the first holder bases and the second holder bases and to contain shoulders of brushes with brush bristles extended upwardly from the shoulders of the brushes intermediate the first holder walls and the second holder walls.

4. A paintbrush case as described in claim 3 wherein:

first holder bases and second holder bases are positioned on the first wall of the paintbrush case; and first holder bases and second holder bases are positioned on the second wall of the paintbrush case.

5. A paintbrush case as described in claim 4 wherein:

the plurality of first-side brush holders and the plurality of second-side brush holders have handle containers positioned vertically below the first holder bases and the second holder bases respectively.

6. A paintbrush case as described in claim 5 wherein:

the handle containers are pliable straps that are attachable to the first-side wall and to the second-side wall respectively.

7. A paintbrush case as described in claim 5 wherein:

the handle containers are resilient straps that are attachable to the first-side wall and to the second-side wall respectively.

8. A paintbrush case as described in claim 5 wherein:

the handle containers are spring-material straps that are attachable to the first-side wall and to the second-side wall respectively; and the spring-material straps have beveled entries that can be sprung apart by hand-forced insertion of handles of paintbrushes.

9. A paintbrush case as described in claim 2 wherein:

the first-side wall has a first-end wall, a second-end wall, a top wall and a bottom wall;

the second-side wall has a first-end wall, a second-end wall, a top wall and a bottom wall; and the bottom wall of the first-side wall and the bottom wall of the second-side wall are hinged together at proximate a center of the bottom of the paintbrush case.

10. A paintbrush case as described in claim 1 wherein:

air vents are in a top wall and in a bottom wall of the paintbrush case.

11. A paintbrush case comprising:

a center plate having a top edge proximate a top of the paintbrush case, a bottom edge proximate a bottom of the paintbrush case, a first end proximate a first end of the paintbrush case, and a second end proximate a second end of the paintbrush case;

a first-side wall hinged to a first side of the bottom of the paintbrush case;

a second-side wall hinged to a second side of the bottom of the paintbrush case;

air vents in a top wall and in a bottom wall of the paintbrush case;

a plurality of first-side brush holders that are sized and shaped to hold a select plurality, type, size and shape of paintbrushes in handle-down attitude in a first side of the paintbrush case;

a plurality of second-side brush holders that are sized and shaped to hold a select plurality, type, size and shape of paintbrushes in handle-down attitude in a second side of the paintbrush case;

a case handle proximate a top of the paintbrush case;

the first-side wall has a first-end wall, a second-end wall, a top wall and a bottom wall;

the second-side wall has a first-end wall, a second-end wall, a top wall and a bottom wall;

the bottom wall of the first-side wall and the bottom wall of the second-side wall are hinged together at proximate a center of the bottom of the paintbrush case;

the plurality of first-side brush holders are positioned on an inside periphery of the first-side wall;

the plurality of second-side brush holders are positioned on an inside periphery of the second-side wall;

the plurality of first-side brush holders have first holder bases from which first holder walls are extended upward vertically and second holder bases from which second holder walls are extended upward vertically;

the first holder bases and the second holder bases are positioned a distance apart to allow brush handles to extend downwardly intermediate the first holder bases and the second holder bases and to contain shoulders of brushes with brush bristles extended upwardly from the shoulders of the brushes intermediate the first holder walls and the second holder walls;

first holder bases and second holder bases are positioned on the first wall of the paintbrush case;

first holder bases and second holder bases are positioned on the second wall of the paintbrush case; and the plurality of first-side brush holders and the plurality of second-side brush holders have handle containers positioned vertically below the first holder bases and the second holder bases respectively.

12. A paintbrush case as described in claim 11 wherein:

the handle containers are pliable straps that are attachable to the first-side wall and to the second-side well respectively.

13. A paintbrush case as described in claim 11 wherein:

the handle containers are resilient straps that are attachable to the first-side wall and to the second-side wall respectively.

14. A paintbrush case as described in claim 11 wherein:

the handle containers are spring-material straps that are attachable to the first-side wall and to the second-side wall respectively; and the spring-material straps have beveled entries that can be sprung apart by hand-forced insertion of handles of paintbrushes.

15. A paintbrush case comprising:

a center plate having a top edge proximate a top of the paintbrush case, a bottom edge proximate a bottom of the paintbrush case, a first end proximate a first end of the paintbrush case, and a second end proximate a second end of the paintbrush case;

a first-side wall hinged to a first side of the bottom of the paintbrush case;

a second-side wall hinged to a second side of the bottom of the paintbrush case;

air vents in at least one wall of the paintbrush case;

a plurality of first-side brush holders that are sized and shaped to hold a select plurality, type, size and shape of paintbrushes in handle-down attitude in a first side of the paintbrush case;

a plurality of second-side brush holders that are sized and shaped to hold a select plurality, type, size and shape of paintbrushes in handle-down attitude in a second side of the paintbrush case;

a case handle proximate a top central portion of the center plate;

the plurality of first-side brush holders are positioned on a first side of the center plate; and the plurality of second-side brush holders are positioned on a second side of the center plate.

16. A paintbrush case as described in claim 15 wherein:

the plurality of first-side brush holders have first holder bases from which first holder walls are extended upward vertically and second holder bases from which second holder walls are extended upward vertically;

the first holder bases and the second holder bases are positioned a distance apart to allow brush handles to extend downwardly intermediate the first holder bases and the second holder bases and to contain shoulders of brushes with brush bristles extended upwardly from the shoulders of the brushes intermediate the first holder walls and the second holder walls; and the plurality of first-side brush holders and the plurality of second-side brush holders have handle containers positioned vertically below the first holder bases and the second holder bases respectively.

17. A paintbrush case as described in claim 16 wherein:

the handle containers are pliable straps that are attachable to the first-side wall and to the second-side wall respectively.

18. A paintbrush case as described in claim 16 wherein:

the handle containers are resilient straps that are attachable to the first-side wall and to the second-side wall respectively.

19. A paintbrush case as described in claim 16 wherein:

the handle containers are spring-material straps that are attachable to the first-side wall and to the second-side wall respectively; and the spring-material straps have beveled entries that can be sprung apart by hand-forced insertion of handles of paintbrushes.

20. A paintbrush case as described in claim 15 wherein:

the center plate has a first-end wall, a second-end wall, a top wall and a bottom wall;

a bottom edge of the first-side wall is hinged to a first side of the bottom wall of the center plate;

a bottom edge of the second-side wall is hinged to a second side of the bottom wall of the center plate;

a top edge of the first-side wall is attachable selectively to a first side of the top wall of the center plate;

a top edge of the second-side wall is attachable selectively to a second side of the top wall of the center plate; and air vents are positioned in the top wall and the bottom wall of the center plate selectively.

* * * * *